US005370271A

United States Patent [19]

Segatz

[11] Patent Number: 5,370,271

[45] Date of Patent: Dec. 6, 1994

[54] DISCHARGE APPARATUS FOR PASTY MATERIALS

[75] Inventor: Wilhelm Segatz, Wendlingen, Germany

[73] Assignee: ARA-Werk Kramer GmbH, Unterensingen, Germany

[21] Appl. No.: 30,623

[22] Filed: Mar. 12, 1993

[30] Foreign Application Priority Data

Mar. 17, 1992 [DE] Germany ..... 4208451

[51] Int. Cl.[5] ..... B65D 35/28

[52] U.S. Cl. ..... 222/95; 222/105; 222/326

[58] Field of Search ..... 222/326, 154, 159, 389, 222/391, 95, 105; 211/70.6, 13

[56] References Cited

U.S. PATENT DOCUMENTS

| | | | |
|---|---|---|---|
| 3,338,478 | 8/1967 | Hedblad | 222/154 |
| 3,933,273 | 1/1976 | Cox | 222/391 |
| 4,090,639 | 5/1978 | Campbell et al. | 222/391 |
| 4,231,492 | 11/1980 | Rios | 222/326 |
| 4,330,070 | 5/1982 | Doubleday | 222/326 |
| 4,664,299 | 5/1987 | Gonclaves | 222/327 |
| 4,840,293 | 6/1989 | Segatz | 222/94 |
| 5,080,240 | 1/1992 | Williams | 211/70.6 |
| 5,161,715 | 11/1992 | Giannuzzi | 222/328 |

FOREIGN PATENT DOCUMENTS

| | | |
|---|---|---|
| 8710104 | 10/1987 | Germany . |
| 3919591 | 12/1989 | Germany . |
| 672472 | 11/1989 | Switzerland . |

*Primary Examiner*—Andres Kashnikow
*Assistant Examiner*—Philippe Derakshani
*Attorney, Agent, or Firm*—Quarles & Brady

[57] ABSTRACT

Discharge apparatus for pasty materials particularly in the form of a sealing gun and which is constructed as a quick change system. A replaceable fitting of an integrated, air-tight sealable cylinder unit to a feed means is provided and which can be constructed as a manually or pneumatically operated feed device. As a result of a releasable quick connection, it is possible to rapidly change cylinder units with different sealing compounds or colours for the following operation. The pasty materials in the air-tight sealed cylinder unit can be stored and transported over a longer period in the ready-to-use state.

9 Claims, 2 Drawing Sheets

DISCHARGE APPARATUS FOR PASTY MATERIALS

Figure 1:
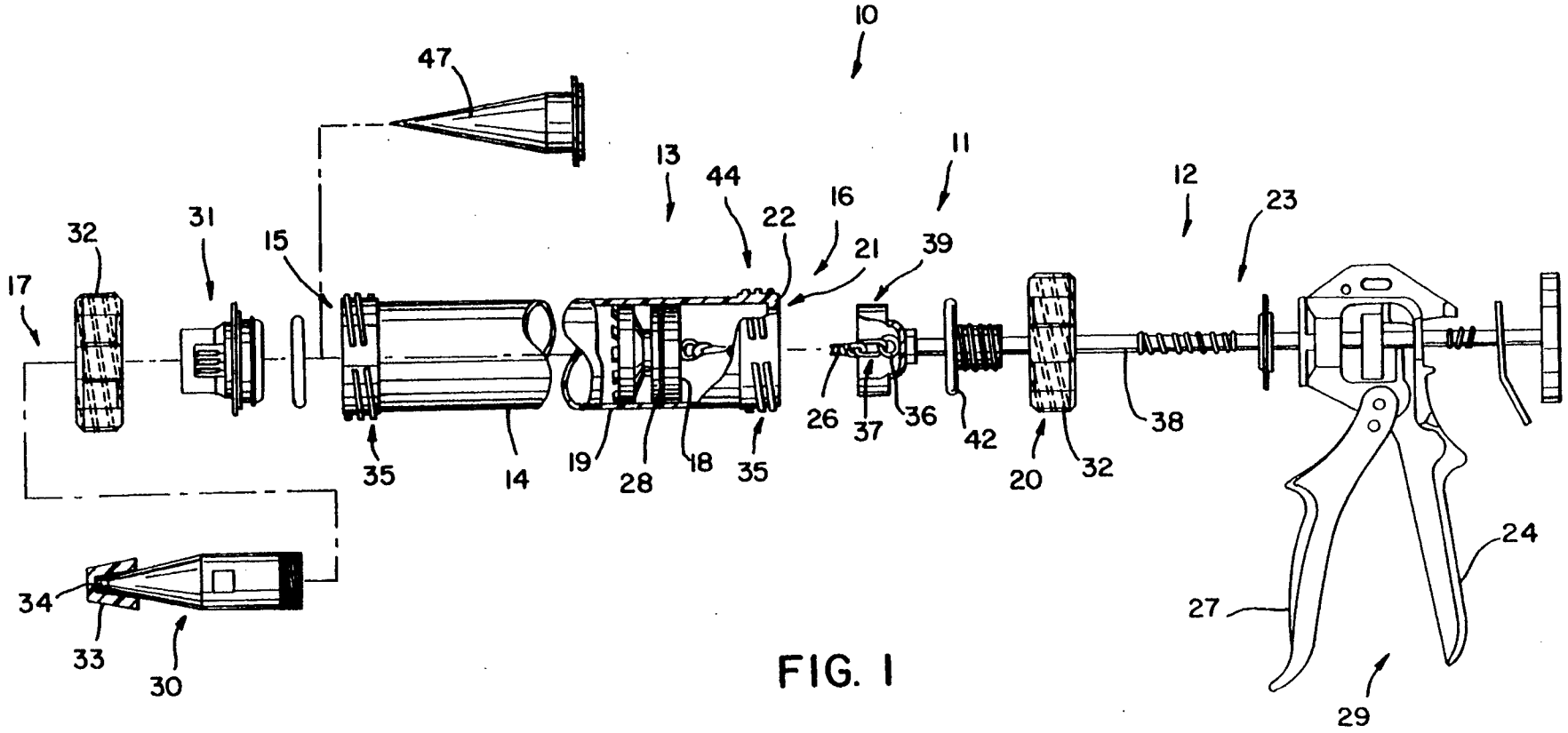

The invention relates to a discharge apparatus for pasty materials, particularly sealing guns or the like, with a delivery cylinder which can be filled with pasty materials and which has on a discharge-side face a discharge opening, a feed piston movable in the delivery cylinder against the discharge opening and which sealingly cooperates with the delivery cylinder wall and a feed means for the feed piston connected to the cylinder.

Discharge apparatuses or sealing guns are used in the building industry, particularly in the construction of windows and in connection with sanitary devices, in order to discharge in strand-like manner plastic compounds or sealants, such as putty, cement and sealing compounds from film bags.

U. S. Pat. No. 4,840,293 discloses an apparatus constructed in this form as a compressed air sealing gun, which has a cylinder for filling with a cylindrical film bag containing the plastic compound and a feed piston at one end of the cylinder, together with a delivery opening at the opposite cylinder end. The delivery opening is provided on a screw-on locking cap, which is connected to the cylinder. By means of a handle arranged centrally on the cylinder the sealing gun can be kept in the desired working position. By the operation of the operating lever provided on the handle the discharge of the sealing compound is obtained by the pneumatically driven feed piston.

German Patent 3,919,591 also discloses a pneumatically operated sealing gun, whose construction corresponds to that described in U.S. Pat. No. 4,840,293. The delivery cylinder provided for this purpose is made from a transparent material and has screw-on locking caps on its outer ends.

In practice the situation is frequently such that numerous different colours and types of pasty materials are required for adapting to different types and possibly coloured components and sanitary fittings. It is therefore often necessary to frequently replace the film bag before the latter may be completely emptied. For such a change, prior to the refilling of the gun, it is necessary to clean the interior of the reception cylinder and clean or replace the discharge nozzle, so as to avoid any mixing between the previous colour and the new colour or type of pasty material. This requires numerous complicated operations, which require a considerable amount of time.

It is also necessary for the partly emptied film bag to be resealed at its opened front face, so as to prevent a complete polymerizing or drying of the product. It is also a risky process to store the unstable and partly emptied film bag or flow pack.

The problem of the invention is to facilitate the changing of pasty materials.

According to the invention this problem is solved by a discharge apparatus for pasty materials according to claim 1, in which the discharge apparatus is constructed as a quick change system and permits an interchangeable fitting of at least one integrated, tight cylinder unit to the feed means. This leads to a discharge apparatus for pasty materials, which allows a simple and rapid replacement and use of different pasty materials for the particular application, whilst simultaneously providing a ready-to-use, durable and reliable storage of the possibly partly emptied film bag.

The quick change system brings about a simple and time-saving replacement of integrated, air-tight cylinder units. The cylinder units used can be filled with a corresponding sealing compound for the subsequent operation. It is therefore advantageously possible to provide several cylinder units with different filled pasty materials, such as e.g. silicone, polyurethane, acrylics, etc., so as to permit rapid access to the necessary sealants for the large number of variants occurring in practice. There is consequently no need for a time-consuming cleaning of the interior of the reception cylinder and the discharge nozzle. It is also not necessary to seal the replaced, partly emptied film bag, because the latter remains in the air-tight cylinder unit.

As a result of the air-tight sealing of the cylinder unit a polymerizing or drying out of the pasty material therein is prevented. Therefore these cylinder units intended for processing or colour changes can be stored in a ready-to-use state for a longer period. The number of replaceable cylinder units can be determined by the necessary number of continuously used, different sealant colours or types.

The discharge apparatus can in particular be constructed for the use of film bags and for loose, pasty materials. A processing of pasty materials in cartridges is to be avoided.

The quick change system advantageously links the cylinder unit with the feed means by means of a detachable quick connection to a ready-to-use discharge or delivery apparatus, particularly a sealing gun. The detachable quick connection can have snap connecting elements, quick coupling elements or be in the form of a bayonet catch and preferably a quick screw connection, e.g. with a cap nut or the like is provided. In addition, the releasable quick connection can have a securing device, which prevents the unintentional release of the change system.

It is also advantageous that the integrated cylinder unit comprises a delivery cylinder optionally filled with pasty material, a closable discharge opening and a feed piston. The delivery cylinder is preferably constructed from an at least partly transparent and preferably completely transparent material. This makes it possible to easily check the fill height of the film bag and the nature and colour of the pasty material.

The delivery cylinder is advantageously made from a pressure-resistant material for operating pressures up to 10 bar and preferably 4 to 8 bar. In particular, the delivery cylinder is constructed for a safety compression strength of at least 30 bar and can be formed from a transparent plastics material, such as e.g. ABS, PP, PA or PE. The delivery cylinder can also be formed from a preferably transparent composite material produced by coextrusion and which is in particular designed for high compressive stresses. This composite material can also be produced by injecting or spraying round a stabilizing insert.

At least at its end connectable to the feed means, the delivery cylinder advantageously has a double helical outer thread with preferably a single thread element, so that the screw connection constructed as a screw cap is connectable to said cylinder in a rotation of less than 360°. The threads which are preferably identically constructed at both ends are advantageously interrupted in the vicinity of the separating plane of injection moulds for removing the cylinder therefrom. This offers the advantage that in the injection mould there is no need for undercuts and a clean thread element can be produced.

At one discharge-side face of the delivery cylinder is provided a closable discharge opening, which has a delivery nozzle or an intake connection for such a nozzle. The closable discharge opening can be provided in a screw cap located at the discharge-side face and which can be constructed in similar manner to the screw cap of the quick connection. By closing the delivery opening, e.g. with a locking cap, the delivery cylinder is sealed in air-tight manner on the discharge side. The locking cap can be detachably fixed to the cylinder unit, preferably on the front or discharge-side screw cap. The delivery opening is at least closed if there is within the delivery cylinder a discharge-ready, pasty material, e.g. in the form of an opened film bag.

By means of the detachable, front screw cap on the delivery cylinder it is possible to make use of different types and sizes of discharge nozzles, which e.g. are dependent on the viscosity of the material. For the discharge of the pasty material filled into the delivery cylinder use is advantageously made of a feed piston as described in U.S. Pat. No. 4,840,293. This feed piston is fitted into the delivery cylinder and advantageously seals in air-tight manner the delivery cylinder end detachable from the feed means. The feed piston can have a sealing element, preferably a sealing ring, which is not necessary for the conventional mechanical discharge apparatuses. It is also possible to provide a radial feed spring on the feed piston. Therefore this functional unit sealed in air-tight manner and detached from the feed means can form a container or pack protecting the film bag and which firstly offers a transport protection of the carried along film bag to be used for replacement purposes and secondly permits a reliable storage of the at least partly emptied, unstable film bag.

Advantageously on the pressure-side face of the delivery cylinder detachable from the feed means, said cylinder has a drop-out preventer for the feed piston and which can be in the form of a constriction projecting into the internal diameter of the inner wall of the delivery cylinder. This constriction can be formed by an inwardly projecting, all-round edge or rim or by inwardly projecting segments, which are preferably in one piece with the cylinder wall. The constriction can also be formed by a ring placeable on the detachable end face, e.g. by a snap, screw, adhesive, press or similar connection. This constriction prevents an unintentional pressing out of the feed piston from the delivery cylinder, particularly when filling said cylinder with a pasty material or a film bag. Moreover, this inwardly projecting step provides security for the transportation and storage of the cylinder units ensuring that the feed piston does not unintentionally drop out.

The quick change system can have both mechanically and pneumatically operated feed means. The detachable quick connections are preferably provided in unitary manner, so that the integrated cylinder units can be used both for mechanical and pneumatic purposes.

The mechanically operating feed means are preferably constructed as manually operable feed devices. Pneumatically operating feed means are preferably connected by means of a pressure line to a compressor. The feed means are advantageously feed devices having in the vicinity of the connection to the cylinder unit an operating member. These operating devices can have at least one operating lever for operating the discharge apparatus and optionally a handle.

An operating member provided for the feed means can be mechanically or pneumatically connected by means of the detachable quick connection to the pressure-side face of the feed piston for the transfer of the feed forces. The release of the quick connection also releases the connection between the operating member and the feed piston.

For the mechanical feed mechanism of a discharge apparatus or hand pressure gun the operating member can have a feed rod and a preferably disk-like pressure block fitted to its piston-side end. It can engage on the back of the feed piston and press the latter axially in the discharge direction.

An advantageous further development of the feed device can be obtained by a permanent arrangement of the operating member on part of said device, e.g. in the vicinity of the rear or pressure-side screw cap. For this purpose a feed device, which has the quick connection, an operating member and an optionally provided handle, is releasable as a feed unit from the delivery cylinder, so that a simple and rapid change system can be created.

A pneumatically driven feed mechanism can have an operating member with a releasable transition piece, which can be constructed as a pressure relief valve, which is preferably also detachable from the cylinder unit by the releasable quick connection. The discharge of the sealing compound from the discharge apparatus can be brought about by operating an operating lever, so that the pressure exerted on the feed piston can be controlled by means of the transition piece. The operating lever can be physically provided directly on a part of the releasable feed device, e.g. on a handle.

It is also possible to provide delivery devices without a handle, because engaging round the delivery cylinder also permits a controlled working of the compressed air sealing gun. Therefore the feed device can be detachably constructed as a physical unit with the delivery cylinder, whilst retaining a high cylinder unit change speed.

Moreover, in the case of pneumatically operating delivery devices, on the back of the feed piston can be fixed a securing cord or chain, which is detachably connected to a releasably connected part of the feed means. This securing cord prevents an unintentional pressing of the feed piston out of the delivery cylinder on opening the latter at the delivery side. The securing cord can be provided on a holding device, e.g. a ring, for rapid and simple fitting with quick change means, preferably spring safety hooks or the like, which are snapped in the ring. The securing cord or chain advantageously remains during a cylinder unit change on the feed piston, because there is easy accessibility for the securing means to the feed device.

The securing cord or chain can advantageously also be connected to the delivery cylinder end connectable to the feed means and is therefore independent of the feed unit. The constriction of the delivery cylinder can advantageously be inwardly displaced. A resulting shoulder can receive a holding element, preferably a perforated disk, to which the securing string or chain is preferably detachably fixed.

Preferably the pasty materials are filled into transparent film bags, so as to allow an easy colour detection of the sealing compounds. The transparency of the delivery cylinder can be reduced to a window area, so as to make it possible to accurately read off the filling level and colour of the pasty compound.

In an embodiment of the quick change system, which is constructed as a processing change or colour change and storage system for sealants, it is also possible to add the pasty compound directly into the delivery cylinder without any prior packing. As a result of the interchangeability of the individual cylinder units there is no need for the complicated cleaning process when the colour or type of the pasty compound is changed. Therefore it is possible to accept larger drums of the individual pasty materials, e.g. sealants and, if necessary, reusable refilling and delivery cylinders can be filled up again.

The invention also relates to a cylinder unit for a discharge apparatus, which has a delivery cylinder fillable with pasty compound. On a discharge-side face can be provided a closable discharge opening and its opposite side can have a quick coupling element for quick connection to a feed device. The quick coupling element can be constructed as a thread, a snap element or the like. In the delivery cylinder can also be provided a sealingly displaceable feed element, which is e.g. constructed as a feed piston. This can seal in air-tight manner the side opposite to the discharge-side face. The cylinder unit more particularly serves as an independent pack for unpacked pasty materials or opened tubular bag packs of pasty materials, which are sensitive to air and/or moisture.

The cylinder unit is also provided with a fall-out preventer, which is located on the end having the quick coupling element, so that the feed element can be held in the delivery cylinder. Thus, a cylinder unit is provided sealing in air-tight manner the size-variable cylinder capacity provided for the pasty materials.

These and further features can be gathered from the claims, description and drawings of preferred embodiments and the individual features, either singly or in the form of subcombinations, can be realized in an embodiment of the invention and in other fields and can represent advantageous, independently protectable constructions for which protection is hereby claimed. Embodiments of the invention are described in greater detail hereinafter relative to the drawings, wherein show:

FIG. 1 a diagrammatic view of a mechanical discharge apparatus.

Figure 2:
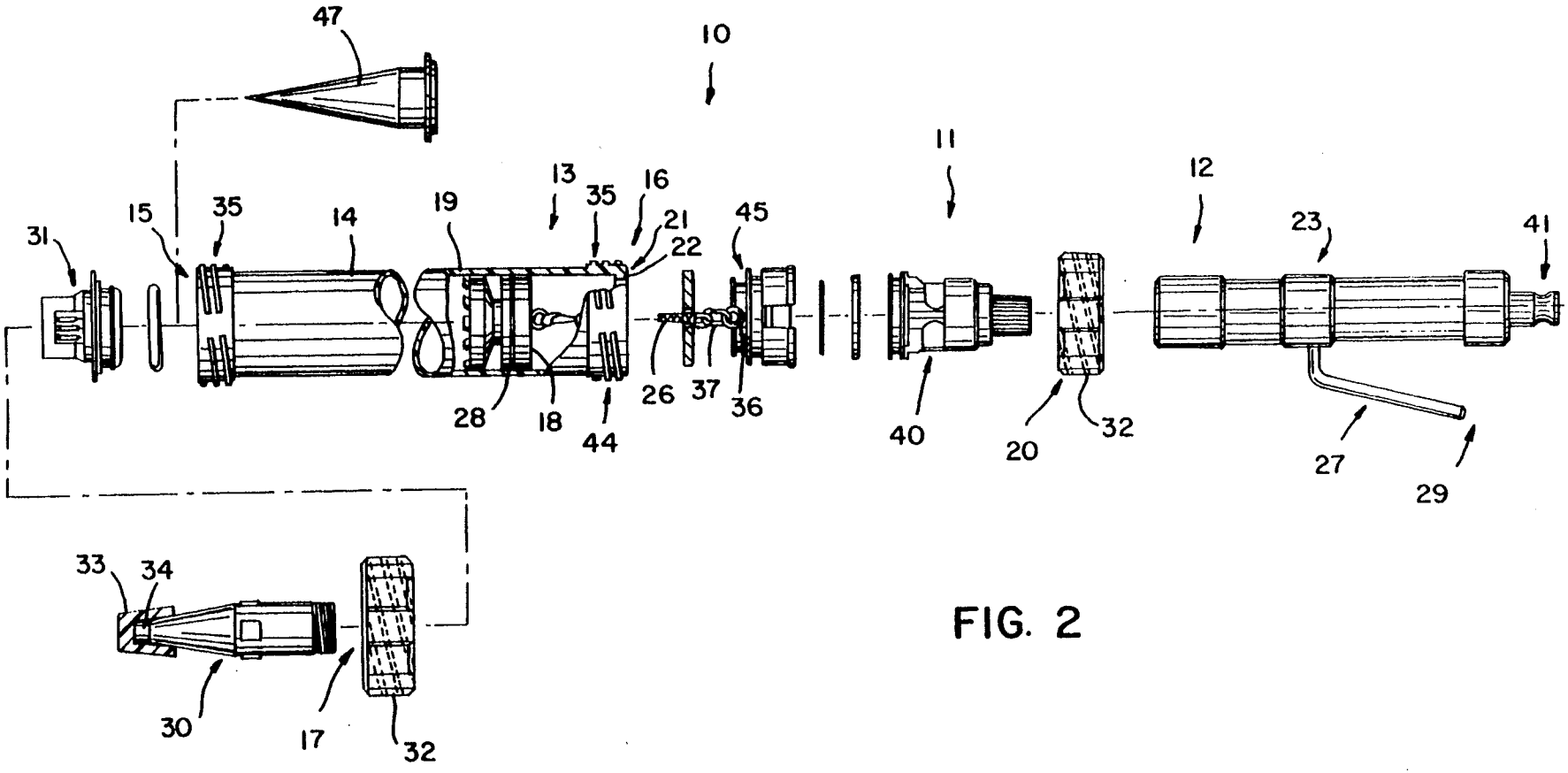

FIG. 2 a diagrammatic view of a pneumtic discharge apparatus.

FIG. 1 shows a discharge apparatus 10 for pasty materials, particularly a sealing gun, which is constructed as a quick change system 11. The discharge apparatus 10 has a feed device 12, to which is replaceably fitted an integrated, air-tight sealable cylinder unit 13. The integrated cylinder unit 13 has a hollow delivery cylinder 14 fillable with pasty material, a closable discharge opening 17 provided on a discharge-side face 15 of the cylinder 14 and a feed piston 18 provided in the cylinder 14 on a face 16 connectable with the feed device 12 on the pressure side and facing the discharge-side face 15, said piston 18 being sealed against a cylinder wall 19, independently of whether the feed takes place pneumatically or mechanically. The closable discharge opening 17 is formed from a replaceable delivery nozzle 30, which can be screwed to or inserted on an intake connection 31, as well as a front screw cap 32 detachable from the delivery cylinder 14. This front screw cap 32 can be screwed onto the discharge-side face 15 and fixes the delivery nozzle 30 or the intake connection 31 to the delivery cylinder 14. A locking cap 33 is also detachably provided on the front screw cap 32 and seals in air-tight manner the outlet port 34 of the delivery nozzle 30. The releasable, front screw cap 32 permits an easy changing of different types and sizes of delivery nozzle 30.

The delivery cylinder 14 has on its discharge-side face 15 and its pressure-side face 16 identical threads 35, which are constructed as double helixes and in each case have a thread element with a 180° displacement. The threads 35 are shaped in one piece with the wall 19 of the delivery cylinder 14.

The delivery cylinder 14 is made from a transparent, pressure-resistant plastics material and is tubular. On the pressure-side face 16 is provided a drop-out preventer 21, which is formed by a constriction projecting into the internal diameter of the delivery cylinder 14 or which is in the form of an inwardly projecting rim 22. This rim 22 is shaped in one piece with the cylinder wall 19 and is circular. As a result any passing out of the feed piston 18 on the pressure-side face 16 is prevented.

The feed piston 18 is constructed in accordance with EP 254,969 B1 (particularly FIG. 6), to which reference is made. The feed piston 18 engages flush on the cylinder inner wall 19 and has a sealing ring 28, which seals in air-tight manner the interior of the delivery cylinder 14 with respect to the pressure-side end 16 or the releasable part of the feed device 12. On the back of the feed piston 18 is provided a ring-like reception element 36, to which is detachably fixed a securing string or chain 26 by means of a quick connecting means 37, preferably a spring safety hook.

The cylinder unit 13 is connected by a detachable quick connection or coupling 20 to the feed device 12 in the form of a quick screwing system. The quick connection 20 has a rotatable rear screw cap 32 on the feed device 12. The rear screw cap 32 has a double helical internal thread with a thread length of less than 360°. Therefore the delivery cylinder 14 can be released from the feed device 12 or fixed thereto in less than one turn or revolution, so that release or fixing is possible without having to grasp with the hand, as is the case with longer threads. This rear screw cap 32 for fixing the delivery nozzle 30 is identical to the front screw cap 32 of the fast coupling.

The feed device 12 has an operating member 23 with an operating device 29 through which the operating member 23 can be moved in the axial direction of the delivery cylinder 14. The operating device 29 comprises a handle 24 and an operating lever 27. The operating member 23 has a feed rod 38, which rotatably receives the screw cap 32 and by means of a fastening screw 42 detachably holds it on the handle 24. The feed rod 38 has on the end pointing towards the feed piston 18 a replaceable and preferably disk-like pressure block 39, which engages on the feed piston 18. The external diameter of the disk-like pressure block 39 is such that it is smaller than the diameter formed by the constriction 22. On the inner connecting face of the pressure block 39 there is also a ring-like reception element 36, to which is detachably fixed the second end of the securing string 26 by means of a spring safety hook 37 located thereon. The connection between the ring-like reception element 36 and the spring safety hook 37 on the feed piston 18 and also on the inside of the pressure block 39 is constructed in such a way that the outer, all-round rim of the pressure block 39 can engage directly on the back of the feed piston 18.

The further construction of the mechanical feed device 12 with respect to the operation of the operating member 23 is already known from discharge apparatuses for replaceable cartridges.

The operation of the discharge apparatus or hand sealing gun constructed as a quick change system will now be explained. In order to change over the discharge apparatus 10 constructed as a quick change system 11 for a following operation, which requires a different pasty material from the preceding operation, a replacement takes place of the integrated, air-tight cylinder unit 13 of the discharge apparatus 10. After closing the discharge nozzle 30 or outlet port 34 by the locking cap 33, the rear screw cap 32 constructed as a detachable quick connection 20 is released. The feed device 12 and the air-tight cylinder unit 13 are separated from one another. The securing cord 26 is released, said cord keeping in loose connection the delivery cylinder 14 and the feed device 12. By disengaging the safety hook 37 on the ring-like receptacle 36, which preferably takes place on the detachable part of the feed device 12 or on the disk-like pressure block 39, the cylinder unit 13 can be completely removed from the feed device 12. The securing cord 26 can also be fixed to the cylinder inner rim 22 forming the constriction 22, so that there is no need to release the securing cord 26.

For the following operation a corresponding, pasty compound-filled cylinder unit 13 can be fixed in the reverse order to the feed device 12. By rotating the screw cap 32 by less than 360° and preferably 180° a rapid change takes place with a minimum number of manipulations. The replaceable cylinder unit 13 serves as an air-tight pack and protects the partly emptied film bag by a pressure-resistant delivery cylinder 14 against damage or bursting. The pack released from the feed unit 12 always has the volume corresponding to the residual pasty material quantity. 3

The drop-out preventer 21 also ensures that there is no drop out and loss of the feed piston 18 from the pressure-side face 16, so that the cylinder unit 13 remains sealed in air-tight manner during transportation and storage.

Advantageously a storage rack is formed for the replacement cylinder units 13 and permits the storage and transportation of different types and colours of pasty materials. The storage rack can advantageously have 6 to 20 compartments for cylinder units 13 and/or film or tubular bags. It can be in the form of a bottle support frame and preferably also has a compartment for the delivery device or the feed device. Therefore the air-tight cylinder units 13 are constantly accessible, so that a flexible, labour-saving quick change system 11 is created.

Advantageously the cylinder units are essentially vertically stored, as is the case with bottles in carrier racks. With that it has proved to be favourable to position the cylinder units in a way that the discharge-side face 15, in particular the delivery nozzle 30, are directed downward. Therefor according seats for the delivery nozzles projecting from the discharge-side faces 15 can be provided in the lower section of the storage rack. Thus, there are means provided to retain the feed piston 18 constantly in connection to the film bag during transport, even in case shaking of the storage rack should occur during transport. As well a helical pressure spring compensating the dead weight of the delivery piston could be provided therfor.

The filling of the cylinder unit 13 with pasty material can take place independently of whether the cylinder unit is fixed to the feed device 12 or not. By screwing the front screw cap 32 onto the discharge-side face 15 the delivery nozzle 30 and the optionally provided intake connections 31 can be removed. The emptied, compressed film bag 47 is removed and replaced by a new bag 47, so that during filling the feed piston 18 is simultaneously moved back into a rear position, which can also be reached by pulling on the securing cord 26.

After opening the newly filled film bag the outlet port 17 is closed again and the discharge apparatus 10 is ready to operate.

FIG. 2 shows a discharge apparatus 10 constructed as a quick change system 11 and which is operated by compressed air. This integrated, air-tight sealable cylinder unit 13 has an identical construction to that described relative to FIG. 1. Therefore the integrated cylinder unit 13 is interchangeably provided for a mechanical hand pressure gun and for a compressed air gun. The compressed air-operated feed device 12 has a screw cap 32 constructed as a releasable quick connection 20 which is releasably and in particular rotatably provided with an operating member 23. The operating member 23 has a compressed air connection 41, an operating device 29 constructed as an operating lever 27 and a transition piece 40 releasable from the operating member 23 and which can be constructed as a pressure relief valve. By means of the operating lever 27 the feed-determining pressure of the feed piston 18 is controlled. The compressed air-operated feed device 12 is constructed as a physical unit, so that there can be a problem-free replacement of air-tight cylinder units 13. On a side 35 directed towards the cylinder unit 13 a coupling assembly 45 has a ring-like reception element 36, to which is detachably fittable the loose end of the securing cord 26. Once again the end of the securing cord 26 directed away from the feed piston 18 can be fixed to the cylinder end, so that there is no need for a release from the feed device 12.

The operation of the quick change system 11 of the compressed air-operated discharge apparatus 10 is identical to that of the manually operated discharge apparatus 10.

I claim:

1. A discharge apparatus (10) for pasty materials, comprising:

a delivery unit fillable with pasty materials, and having a delivery cylinder (14) with a sidewall and with a closable discharge opening (17) on a discharge end, a feed piston (18) contained within the delivery cylinder (14), movable against the discharge opening (17) in the delivery cylinder (14) and cooperating in a sealing manner with the walls of the delivery cylinder (14), and a feed means (12) for connection and disconnection to the delivery unit for operation of the feed piston (18) residing in the delivery cylinder (14), the feed means including a movable operating member (27), wherein a drop-out preventer (21) is provided on a face of the delivery unit (13) connectable to the feed means (12); and quick disconnect means (26, 32) for quick disconnection of the delivery unit (13) including the feed piston from the feed means (12); and wherein the drop-out preventer prevents the feed piston (18) from dropping out of delivery unit (13) when the feed means is disconnected from the delivery unit.

2. A discharge apparatus according to claim 1, wherein the delivery cylinder is filled or fillable with a pasty material-containing tubular bag.

3. A discharge apparatus according to claim 1, wherein the quick disconnect means includes a screw disconnection requiring less than one turn.

4. A discharge apparatus according to claim 1, wherein the feed means is constructed as a mechanically or pneumatically operating feed device with an operating device.

5. A discharge apparatus according to claim 1, wherein the delivery cylinder is made from transparent material which is designed for operating pressures up to 10 bar.

6. A discharge apparatus according to claim 1, wherein the drop-out preventer is constructed as a constriction provided on the releasable end of the delivery cylinder and projecting into the interior of said delivery cylinder from the sidewall to restrict the piston (27) from removal from the delivery cylinder.

7. A discharge apparatus according to claim 1, wherein the drop-out preventer is constructed as an inwardly projecting rim on a releasable end of the delivery cylinder.

8. A discharge apparatus according to claim 1, wherein the delivery cylinder is filled or fillable with a transparent tubular bag containing a pasty material.

9. A cylinder unit for the discharge apparatus according to claim 1 with the delivery cylinder fillable with pasty material and which has on its discharge-side face a sealable discharge opening and on its facing side a quick coupling element for the quick connection to a feed device and in the delivery cylinder is provided a sealably displaceable feed element for the pasty material.

* * * * *